United States Patent [19]

Compton

[11] Patent Number: 4,639,843

[45] Date of Patent: Jan. 27, 1987

[54] LUMINAIRE

[75] Inventor: Wayne W. Compton, Chino Hills, Calif.

[73] Assignee: Kidde Consumer Durables, Corporation, City of Industry, Calif.

[21] Appl. No.: 722,125

[22] Filed: Apr. 10, 1985

[51] Int. Cl.[4] ..... F21V 19/02

[52] U.S. Cl. ..... 362/431; 362/226

[58] Field of Search ..... 362/431, 226, 368, 370, 362/375, 145

[56] References Cited

U.S. PATENT DOCUMENTS

| | | | |
|---|---|---|---|
| 1,807,413 | 5/1931 | King | 362/431 |
| 3,072,784 | 1/1963 | Mann | 362/431 |
| 3,325,950 | 6/1967 | Pfaff | 362/431 |
| 3,530,287 | 9/1970 | Husby | 362/226 |
| 3,798,438 | 3/1974 | Menichette | 362/806 |
| 4,242,726 | 12/1980 | Steadman | 362/431 |

FOREIGN PATENT DOCUMENTS

| | | | |
|---|---|---|---|
| 2394011 | 2/1979 | France | 362/431 |
| 182795 | 5/1959 | Sweden | 362/375 |

*Primary Examiner*—Ronald H. Lazarus

*Attorney, Agent, or Firm*—Donald D. Mon

[57] ABSTRACT

A luminaire having a post and arm whose external surfaces are generally similar in cross-section. The arm extends away from the post and has a window through which light from a lamp passes. The lamp and associated circuit means are on a mount which is engageable by a tracer means of which internal parts of the luminaire can conveniently be installed, removed, and replaced.

13 Claims, 8 Drawing Figures

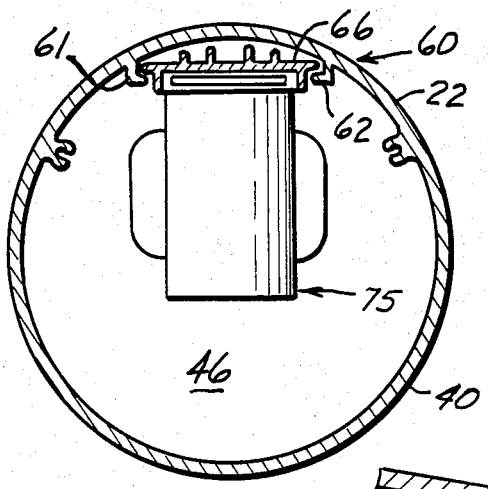
FIG. 6
FIG. 1
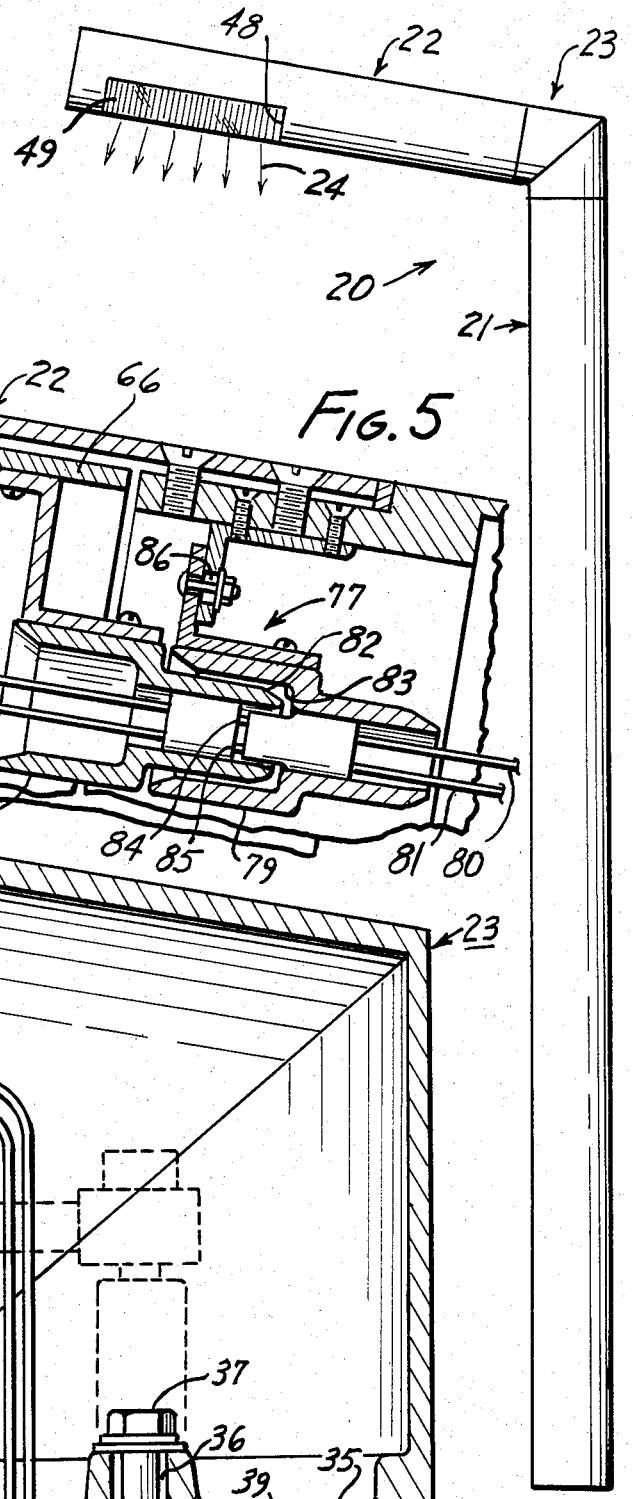
FIG. 5
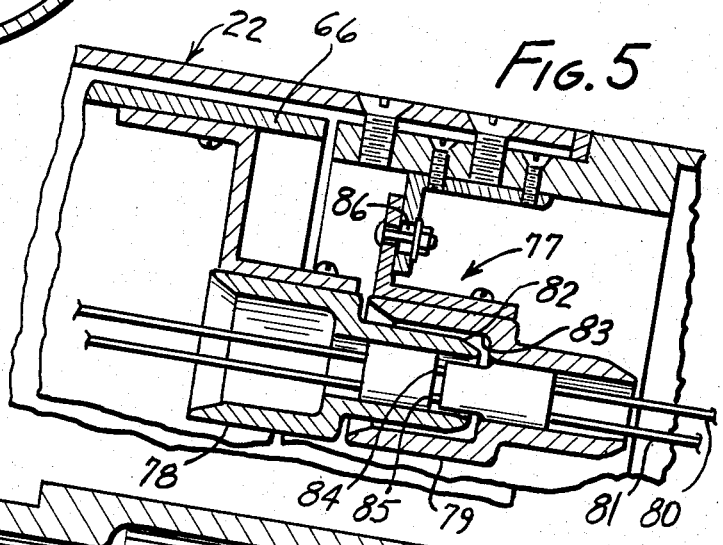
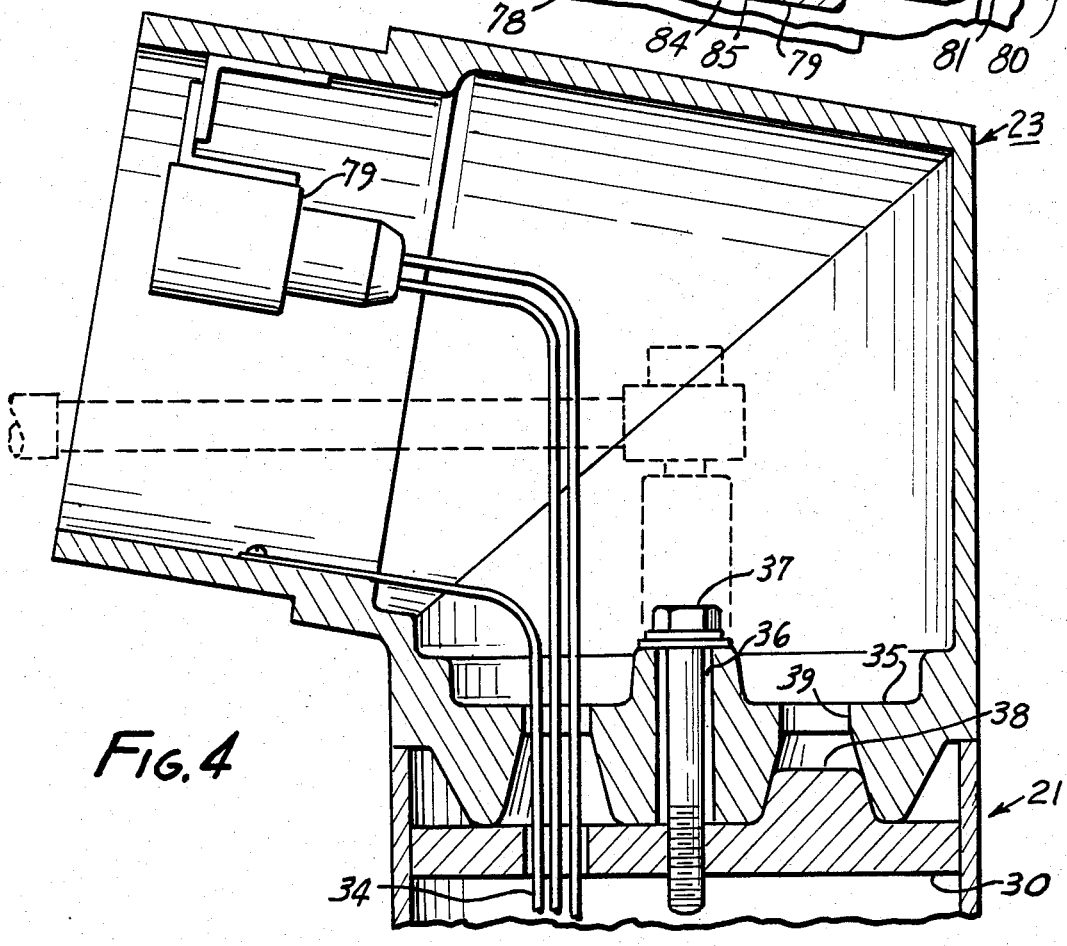
FIG. 4

LUMINAIRE

FIELD OF THE INVENTION

This invention relates to luminaires, and especially to luminaires for architectural and outdoor area lighting applications.

BACKGROUND OF THE INVENTION

Luminaires for architectural and outdoor area lighting are widely used. Street, sidewalk, and parking lot illumination are examples. Such luminaires are generally used in exposed locations, with their lamps and associated circuitry located at substantial heights above the ground. Under these circumstances, convenience of necessary procedures for maintenance such as lamp and ballast replacement and repair is much to be encouraged in the interest of safety, and in the saving of time.

Also, luminaires however much elevated above the ground, form a potentially obtrusive part of the skyline or horizon view. Complicated shapes such as are created by fasteners, joints, and joined parts with different dimensions, tend to clutter the scene, attract the eye, and are frequently unsightly.

Furthermore, because of the exposed locations in which these luminaires are used, it is best to have as few perforations or other openings as possible in them, which might someday leak if their seals fail.

It is an object of this invention to provide a luminaire whose lamp and associated electrical circuitry can quickly, easily and safely be removed, replaced, and repaired. Also, to provide it in such a configuration that it can readily be installed.

It is another object of this invention to provide a luminaire with the above features which can have a uniform, pleasing, and unobtrusive general shape.

It is yet another object of this invention to provide a luminaire which can be equipped with circuit interconnections that are automatically made or broken as a function of the location of the mounting means. By this is meant that the power circuit is broken when some part is removed, and which is restored when the part is replaced.

The above and other features of this invention will be understood from the following detailed description and the accompanying drawings, in which:

BRIEF DESCRIPTION OF THE DRAWINGS

FIG. 1 is a side elevation of the presently preferred embodiment of the invention;

FIG. 4 is an enlarged cross-section view of a portion of FIG. 2;

FIG. 5 is an enlarged detailed view of a portion of FIG. 2 taken at line 5;

FIGS. 6 and 7 are cross sections taken at lines 6—6 and 7—7, respectively, in FIG. 2; and FIG. 8 is a fragmentary side elevation partially in axial cutaway cross section, showing an alternate embodiment of the invention.

DETAILED DESCRIPTION OF THE INVENTION

Figure 2:
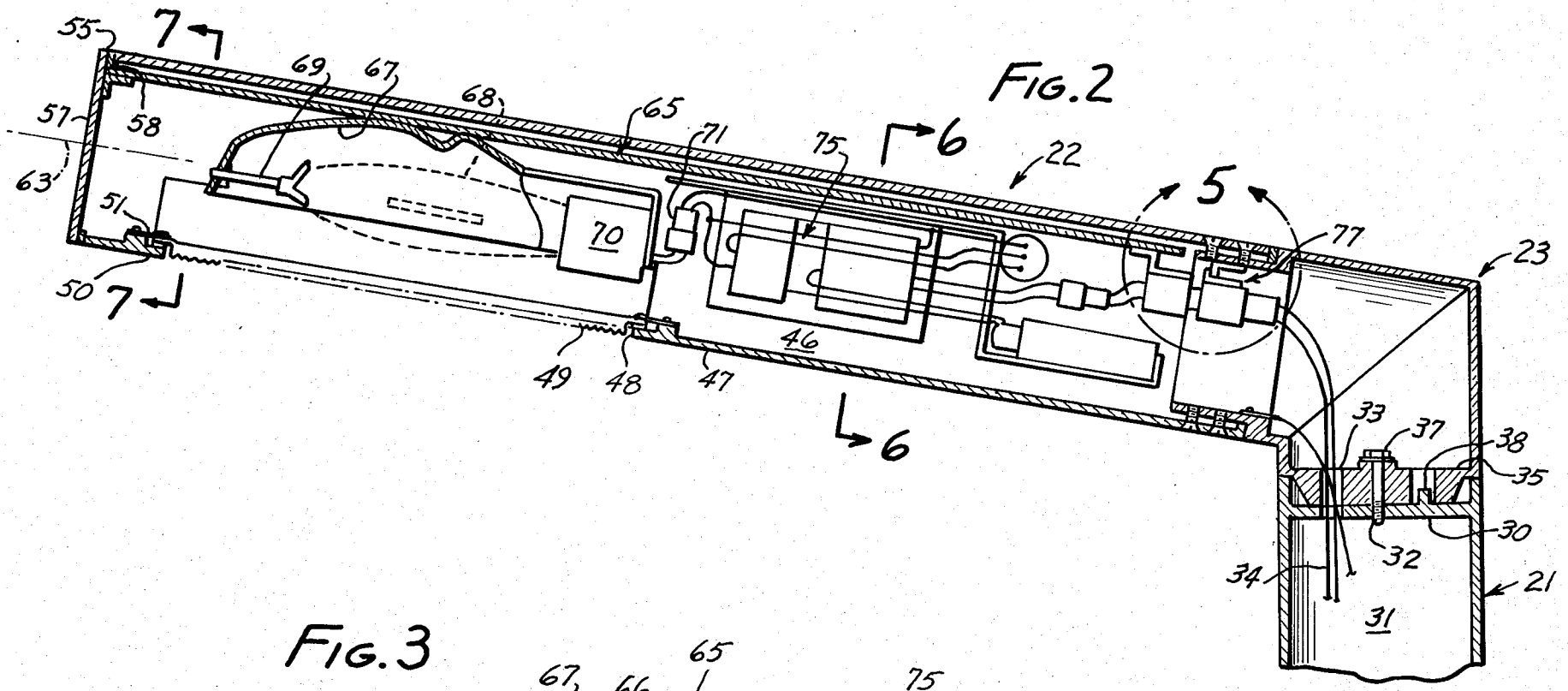
FIG. 2 is an axial cutaway cross section of a portion of FIG. 1.

The presently preferred embodiment of a luminaire 20 according to the invention is shown in FIG. 1. It includes a generally upright tubular post 21 and an arm 22 supported by the post. The arm extends in a generally radial and upwardly sloping direction away from the post. An adaptor section 23 is defined as a part of the arm. It joins to and fairs into the post so as to make a smooth, attractive, and unitary construction. The outer part of the arm is attached to the adaptor. The post is usually attached to some kind of base, which is of no interest to this invention. The objective of the luminaire is to provide illumination schematically shown by arrows 24 to be directed to the ground beneath the luminaire.

It will be noted in this preferred embodiment that the external surfaces of the post and the arm are generally circularly cylindrical. However, circularity or cylindricity of construction is not a limitation on the invention. Instead the constructions may be regarded as generally having a uniform external shape along their length, being substantially identical for both the post and for the arm.

The arm appears to be a general continuation of the post and there is not abrupt change in dimension, or unsightly fussiness to deprive the luminaire of its elegant simplicity. It will be understood that more than one arm may be provided on a post, for example two arms directly across from each other, or three, four or any other number of arms equiangularly spaced from one another around the post. Also, it will be understood that while the post will generally be a vertical member, it can lean or slope, and can include bends and joggles if desired.

In order to provide for simplicity of repair and replacement as well as for installation, the device is customarily made initially in three parts as best shown in FIG. 2. In FIG. 2, the top of the post is shown terminated by a plate 30 which extends across the inside lumen 31 of the post. The post is preferably a circularly cylindrical pipe. A threaded hole 32 is formed in the plate and a passage hole 33 is formed to pass electrical conductors 34 to supply power to the device.

An adaptor section 23 is shown including a tenon plate 35 that has a hole 36 to pass a bolt 37 that is threaded into hole 32. This will draw the lower end of the adaptor down against the upper end of the pipe and draw the tenon plate against plate 30. For anti-rotation means to prevent the arm from rotating in a high wind, a stud 38 is formed on plate 30 which projects into a matching hole 39 in the tenon plate. Thus, the arm may be attached to the post simply by tighting down on bolt 37. Access to this bolt may be had by reaching into the adaptor with a wrench to tighten the bolt. Thus, the assembly of the luminaire is a matter of great simplicity, as is its removal, which may occasionally be required.

Arm 22 is comprised of a body 45 which includes an internal chamber 46 with a peripheral wall 47. An aperture 48 is formed through this wall. Light transmissive means 49 such as a window which may be plain or prismatic provides for emission of light. This aperture is preferably semi-cylindrical in shape and has its edge sealed by a peripheral seal. Means 49 is held in place by leaf springs 51.

Opening 55 opens through the body and gives access to the chamber. Preferably this opening comprises the open end of body 45, the body preferably being a circular cylinder. A removable closure 57 is fittable to opening 55 to close it with a seal 58 between them.

Retention means 60 (FIG. 6) comprises a pair of elongated tracks 61, 62 which are formed in the upper quadrants of the chamber. Preferably the tracks are parallel to axis 63 of the arm. These may conveniently be formed as part of the body itself, the body being an extrusion.

Figure 3:
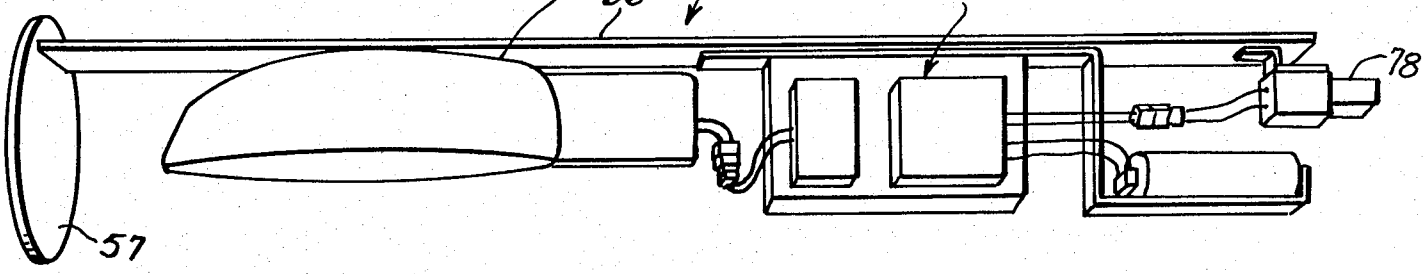
FIG. 3 is a perspective view of a portion of FIG. 2.

Mount means 65 (FIG. 3) is adapted to be passsed through opening 55, releasably to be retained by the retention means. Preferably the mount means comprises a flat plate 66. This plate acts as a rail. It fits in the tracks and can be slid axially toward and away from the post. Its details are best shown in FIG. 3, where it will be noted that it also carries the closure 57. Included in its assembly is a reflector 67 shaped to reflect a desired pattern of light on the ground within which there is placed a lamp 68 that is stabilized in place by lamp snubber 69 (FIG. 2). The lamp fits in a socket 70 which via a connector 71 is connected to circuit means 75. Circuit means 75 includes starters and ballasts according to known principles. The wiring is shown schematically, and will be recognized by persons skilled in the art. All of these devices are attached to the rail and are moved with it.

In addition, between the post (defined as what remains with the post when the tubular arm is removed by releasing screws 76) and the mount means, there is a two part connector 77 having a first part 78 connected to the mount means and a second part 79 connected to structure which remains with the post. It will be noted that these are axially aligned so that when the mount means is moved to the left in FIG. 2, it will effect a master disconnection of the power leads 80, 81. When it is moved into place as shown in FIG. 2, it will constitute a connection of them. The leads then proceed through the hole in passage hole 33 in plate 30 to any desired source of electricity.

The construction of the connector 77 is best shown in FIG. 5, wherein it is shown about to be connected, or in the process of being disconnected. The nose 82 of first part 78 is shown being inserted into the receptacle 83 of the part 81 in the course of which prongs 84, 85 will be connected. Part 79 is connected to its supporting structure, namely the adaptor, by means of a slip joint 86 to provide for lateral adjustment as necessary.

The embodiment thus far described is the preferred embodiment, because the outside of it is very clean in appearance, and has minimal perforations and openings. The only outside connector parts are the screws which hold the body to the adaptor. These may readily be sealed, and because they can be made flush are quite unobtrusive. The result is the appearance of a smooth tubular member that is pleasing to the eye, and which impresses one as a continuation of the post.

Figures 7, 8:
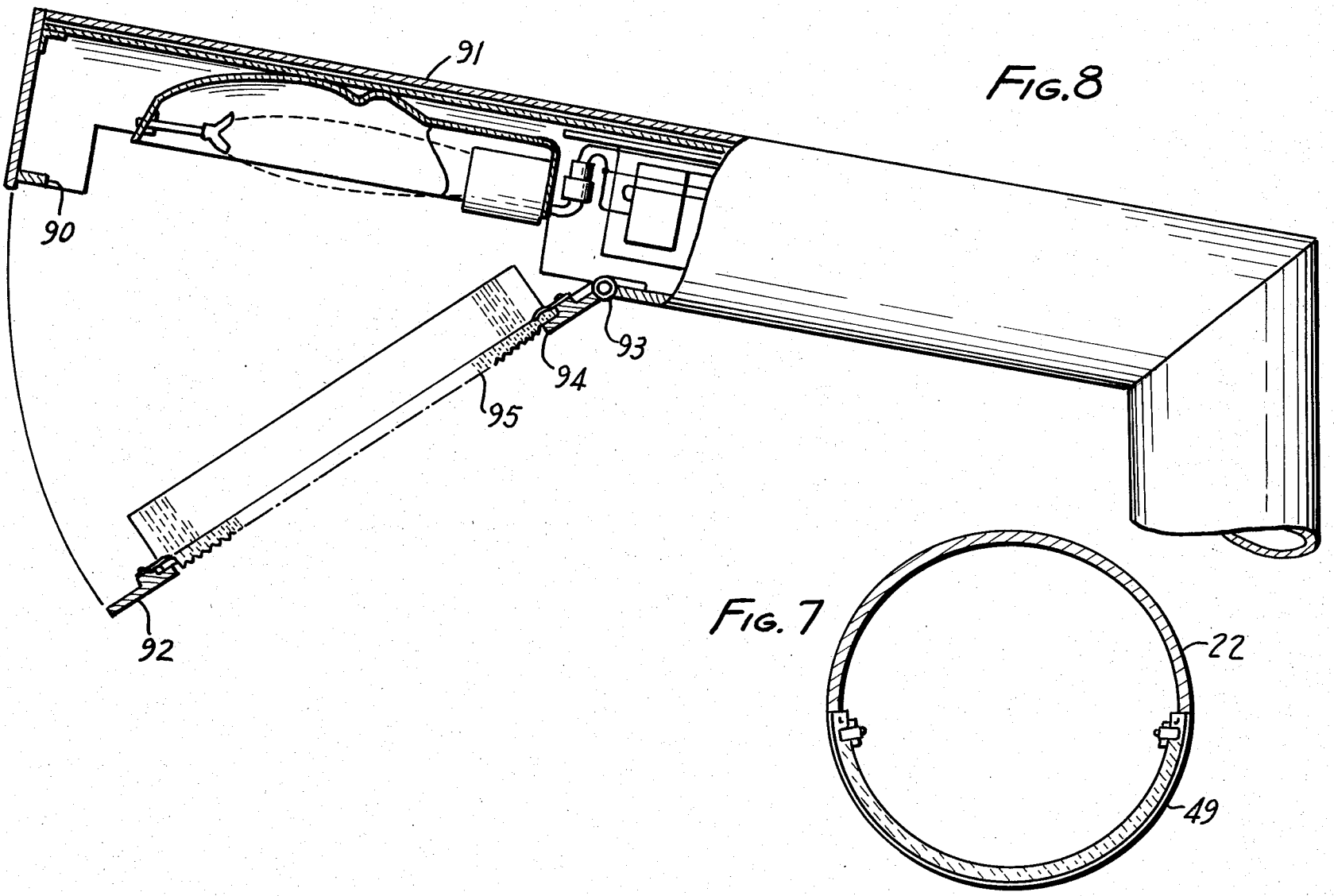

Should cleanliness of the bottom surface of the arm not be a principal objective, then instead of providing an opening at the end of the arm and a closure at the end of the mount means, the arm may be loaded from its bottom side. Then mounting means may comprise more than one plate as convenient. For this purpose, as shown in FIG. 8, opening 90 is provided in arm 91 which is otherwise identical to arm 22, and is provided with a closure 92 which may either be removable such as by clips or screws or may be hinged by a hinge 93 as shown. If desired, this hinge movement could be utilized for a master power cutoff, but in general this will not be considered as effective as the cutoff means already shown. In this case, the aperture 94 with its light transmissive means 95 is placed in the closure itself. The closure then acts as part of the peripheral wall.

In order to load this arm with the lamp and circuit means, the track will be suitably modified such that the mount means can be inserted into the chamber from below and then slid or otherwise moved to the engaged position as already described. For this purpose the rail and mount means will be notched so that one can pass by the other, and then be moved to a position where they interengage with one another, all in accordance with known principles.

Also, if desired, the track may be placed on the closure itself, and the pivotal movement may cause the electrical connection to be made, but this will ordinarily be more complicated than desired.

This invention thereby provides means for mounting the reflector and the associated electrical circuitry in such a way that it can be removed and replaced, or removed repaired and replaced, expeditiously as a unit. Preferably this is done through the removal and replacement through an opening in the end of the arm. According to preferred features of the invention, the closure of the body is accompanied simultaneously by the making of electrical connections, and the electrical connections will be broken as soon as the closure is released. This provides a convenient device which is also very safe for the persons in the field.

This invention is not to be limited by the embodiments shown in the drawings and described in the description, which are given by way of example and not of limitation, but only in accordance with the scope of the appended claims.

I claim:

1. A luminaire comprising:

a post;

an arm supported by said post, said arm comprising: a body having an internal chamber; a peripheral wall; an aperture formed through said wall; and light transmissive means closing said aperture;

an opening through said body giving access ~~to~~ said chamber;

a removable closure adapted to close said opening;

track means in said chamber said track means having an axis;

mount means in said chamber adapted to be releasably retained by said track means and slidable along said axis;

reflector means mounted to said mount means facing toward said aperture and adapted to mount a lamp;

circuit means mounted to said mount means and connected to said lamp; and electrical disconnect means between said circuit means and a source of electrical current, said disconnect means including a first connector mounted to said arm and a second connector mounted to said mount means, said connectors being axially aligned, whereby to make a circuit connection when said mount means is moved so as to join them, and to break said connection when said mount means is moved sufficiently to separate them, after which the mount means may be released from said track means, said mount means, with the reflector and lamps mounted to it, being insertable into said chamber through said opening when said closure does not close said opening.

2. A luminaire according to claim 1 in which said peripheral wall is tubular and has a body axis; in which said opening is at the end of the tube away from the post; in which the track axis is parallel to the body axis; and in which the track means is fixed to the body.

3. A luminaire according to claim 2 in which said closure is also mounted to said mount means, whereby to close said opening when said mount means is fully installed in said chamber.

4. A luminaire according to claim 1 in which said arm includes an adaptor section to mount said arm at a desired angle to said post, and attachment means inside said arm for attaching the arm to the post.

5. A luminaire according to claim 4 in which said body is tubular and in which access to said attachment means is available through said body.

6. A luminaire according to claim 1 in which said opening is formed in said peripheral wall.

7. A luminaire according to claim 6 in which said closure includes said aperture.

8. A luminaire according to claim 7 in which said closure is hinged to said peripheral wall.

9. A luminaire according to claim 2 in which said mount means is adapted to be aligned with said track by relative lateral movement, and slid axially along said track after being aligned.

10. A luminaire according to claim 2 in which the outside of said peripheral wall is cylinqrical.

11. A luminaire according to claim 9 in which attachment means attaches said arm to said post, said attachment means including a threaded bolt accessible through said chamber.

12. A luminaire according to claim 2 in which said peripheral wall and said track are formed unitarily as an extrusion.

* * * * *